US005271571A

United States Patent [19]

Maynard, Jr.

[11] Patent Number: 5,271,571

[45] Date of Patent: Dec. 21, 1993

[54] WATER DRIVEN DEVICE FOR AGITATING AND FRAGMENTING DEBRIS IN A SINK DRAIN

[76] Inventor: Stuart T. Maynard, Jr., 12 Lookout Rd, Asheville, N.C. 28805

[21] Appl. No.: 656,987

[22] Filed: Feb. 19, 1991

[51] Int. Cl.[5] ..... B02C 23/18

[52] U.S. Cl. ..... 241/46.013; 241/46.017; 241/74; 4/286; 4/319; 4/638

[58] Field of Search ..... 241/69, 100.5, 46 R, 241/46 A, 46 B, 46.01, 46.013, 46.017, 74; 4/319, 320, DIG. 4, 286, 287, 288, 638, 629, 295

[56] References Cited

U.S. PATENT DOCUMENTS

| | | | |
|---|---|---|---|
| 936,313 | 10/1909 | Deegan | 4/287 |
| 1,434,066 | 10/1922 | Rodgers | 241/46 B X |
| 1,614,358 | 1/1927 | Gandillon | 241/100.5 |
| 1,720,149 | 7/1929 | Rom | 4/287 |
| 2,012,680 | 8/1935 | Hammes | 241/46.013 X |
| 2,090,299 | 8/1937 | Kuhnle | 4/287 |
| 2,479,485 | 8/1949 | Frank | 4/287 |
| 2,583,997 | 1/1952 | Chester | 241/46.013 |
| 2,753,121 | 7/1956 | Elfenbein | 241/46.017 X |
| 2,761,627 | 9/1956 | Reed | 241/46.013 |
| 2,886,254 | 5/1959 | Rohlinger et al. | 241/74 |
| 2,973,910 | 3/1961 | Federighi et al. | 241/46 B |
| 3,122,969 | 3/1964 | Shames et al. | 241/169.1 X |
| 3,374,958 | 3/1968 | Shive | 241/46 B |
| 3,403,865 | 10/1968 | Guth et al. | 241/46 R |
| 3,439,878 | 4/1969 | Reaux | 241/46.013 |
| 3,777,320 | 12/1973 | Pohtz | 4/287 |
| 3,800,339 | 4/1974 | Bergin | 4/286 |
| 3,802,001 | 4/1974 | Richards | 4/286 |
| 3,813,708 | 6/1974 | Hamburg | 4/286 |
| 4,183,470 | 1/1980 | Horatos et al. | 241/46 B |
| 4,271,540 | 6/1981 | Clifton | 4/DIG. 4 X |
| 4,284,248 | 8/1981 | Adams | 241/169.1 X |
| 4,309,823 | 1/1982 | Antolino et al. | 241/169.1 X |
| 4,386,203 | 5/1986 | Westgerdes | 4/287 |
| 4,902,412 | 2/1990 | Suber, III et al. | 241/46.017 X |
| 5,003,642 | 4/1991 | Robb et al. | 4/287 |

FOREIGN PATENT DOCUMENTS

| | | | |
|---|---|---|---|
| 1141502 | 2/1983 | Canada | 241/100.5 |
| 56311 | 5/1944 | Netherlands | 241/74 |

*Primary Examiner*—Mark Rosenbaum
*Assistant Examiner*—Frances Chin

[57] ABSTRACT

A perforated cylindrical receptacle is fitted within the main cylinder of an ordinary sink drain. A conical elevation of the bottom of the receptacle provides at the apex, a bearing point for a propeller, which may spin by the flow of draining fluid to free and fragment debris. By depressing a spring loaded bearing point, the same propeller can be used to manually force the propeller against the floor of the receptacle to crush and grind more resistant material. A plug placed below the receptacle and prop assembly can be raised or lowered by rotation of the assembly. The assembly is removable for cleaning and inspection.

5 Claims, 2 Drawing Sheets

WATER DRIVEN DEVICE FOR AGITATING AND FRAGMENTING DEBRIS IN A SINK DRAIN

BACKGROUND OF THE INVENTION

While most sinks have at least a common basket filter to catch food debris from going down the drain. Besides catching larger debris that should not be allowed down the drain, a simple basket is easily clogged, even by smaller food fragments which could be allowed to safely pass down a drain. The basket requires manual removal and shaking the basket contents into compost or garbage containers. Some kitchen proprietors elect to have a garbage or food "disposal" which can fragment all sizes of matter to a flushable size.

A number of food disposal devices are known to allow food material to be safely reduced to fragment size which can be carried through household plumbing to larger sewage conduits. In the post World War II period there was an upsurge of electrically powered food "disposal" units to be attached at the base of a sink. Besides requiring assurance of separation of electrical components from moisture, the many electrically powered disposals purposely keep rotors out of reach of hands. The out of sight out of mind context of rotors, also means that these are not available to view for cleaning or inspection and guards must be placed to avoid losing hard objects into the disposal where these damaging objects cannot be easily retrieved.

The plethora of electrically powered devices in a modern kitchen may mean that mechanical assists have been overlooked by inventors for those who continue to prefer a given task in the manual mode. Yet, many households do not have sink disposals and the ever-clogged baskets of the average sink must be diligently cleaned. A few of the ergonomic disadvantages of operating the simple device of a the common basket are outlined:

1. When a basket is overwhelmed with food particles it must be stirred manually, keeping particles suspended, so that a filled sink can be drained. Stirring does not necessarily send particles down the drain, but only suspends them temporarily allowing temporary fluid drainage. The task of stirring is simple but tedious with the fingers or some kitchenware piece as the tool.

2. Once a sink is drained, the basket allows inspection of food debris, but food particles are adherent because of surface tension of the wet, flexible, and soggy matter. To empty the contents into a garbage container, the user may tap the basket upside down or wipe it with fingers or cloth. Even then, the experienced dishwasher knows the necessity of having to rinse small adherent particles in a spray and of flushing the whole drain assembly, which the basket was meant to protect.

3. It is easy to procrastinate in flushing away small adherent food particles only to allow sugars and nutrients to be leached onto the sink and drain surfaces where the growth of fungus films is the result.

The above problems are associated with adherent small particles of food regardless of quantities of large sized pieces of food debris, and the problems are known even to those kitchen operators who diligently scrape and prepare dishware for the process of washing. Both the diligent "scrapers" who do not feel compelled to own a "disposal" and the disposal owner who has a second sink lacking a powered disposal encounter the everyday task of removing small amounts of food debris from a sink.

OBJECTS OF THE INVENTION

Maintaining a simple basket filter on a kitchen sink is an ongoing ritual of tasks involving wiping, stirring, removal, shaking, rinsing, etc.; such tasks may be reduced in frequency with a tool that can be powered by the force of draining fluids in the sink and also manually operated. It is also a desired object to provide a device which is easily removable for inspection and cleaning as necessary. It is intended to provided a tool with the capability to fragment the types of soft matter that clog an ordinary drain basket. The mechanism need not accomplish all tasks, such as to grind up tougher matter such as orange peels or seeds. The mechanism should be adaptable to fit within an ordinary sink drain configuration with minimal modification of existing components common in the industry.

BRIEF DESCRIPTION OF THE INVENTION

The invention may be adapted to the constraints of an ordinary drain which receives a common "drain basket". Such a drain assembly consists of two cylinders: (1) a main cylinder which is commonly $3\frac{1}{4}$" in diameter and approximately $1\frac{1}{4}$" in height with a flared top which merges with the sink bottom and (2) a smaller and lower cylinder which is concentric and about 2" in diameter by $\frac{1}{2}$" in depth. The lower cylinder is a recess which commonly receives the rubber plug portion of the strainer basket; the bottom of the lower cylinder commonly has a slot to receive the pin of a common drain basket in its lower (plugged) position.

The common basket strainer may be permanently removed from use and the invention can replace this function of straining debris from passage into the household plumbing. The invention provides a cylindrical receptacle that may be placed within an ordinary sink drain and allows passage of strained fluids through perforations in the receptacle.

In addition the receptacle has a central, elevated pin which provides the bearing surface for a bladed prop. The prop fits within the diameter of the receptacle and is caused to rotate by the downward flow of fluids allowed to drain from the sink. While rotated by flowing water, a primary action of the prop is to agitate food debris in a sink, so that debris cannot become fixed in perforations and obstruct further fluid flow; this is a fundamental problem in the usage of an ordinary basket strainer.

Since the mounting pin is spring loaded, the prop may be manually pushed to a location of closer clearance with the surrounding receptacle. In this manner, the prop rotated manually against the receptacle with greater force than water can provide can fragment more resistant debris.

Since it is preferred to have the receptacle and prop in place when a sink is full (and plugged) it is necessary to be able to actuate the plug (opening or closure) which should be situated in the typical plug recess of a common drain. The invention provides a screw mechanism for lifting or sealing a plug which is carried beneath the receptacle and prop mechanism.

THE DRAWING FIGURES

DRAWING REFERENCE LIST

| | |
|---|---|
| 1 the invention | 22 blade |
| 2 conventional drain outline | 25 plug |
| 3 main cylinder sidewall | 26 truncated top of cone |
| 4 flared lip | 28 button cone |
| 5 plug recess cylinder | 32 button |
| 6 concentric drain opening | 33 button spring |
| 7 basket pin slot | 34 upper shaft |
| 11 prop basket | 36 lower shaft |
| 12 conical bottom of basket | 38 coarse steep threads |
| 13 basket perforations | 42 pin piece |
| 14 intersection of cone and cylinder | 44 pin machine screw |
| 15 basket tabs | 46 blade sweep outline |
| 20 prop | |
| 21 hub portion | |

DESCRIPTION OF THE PREFERRED EMBODIMENT

Figure 1:
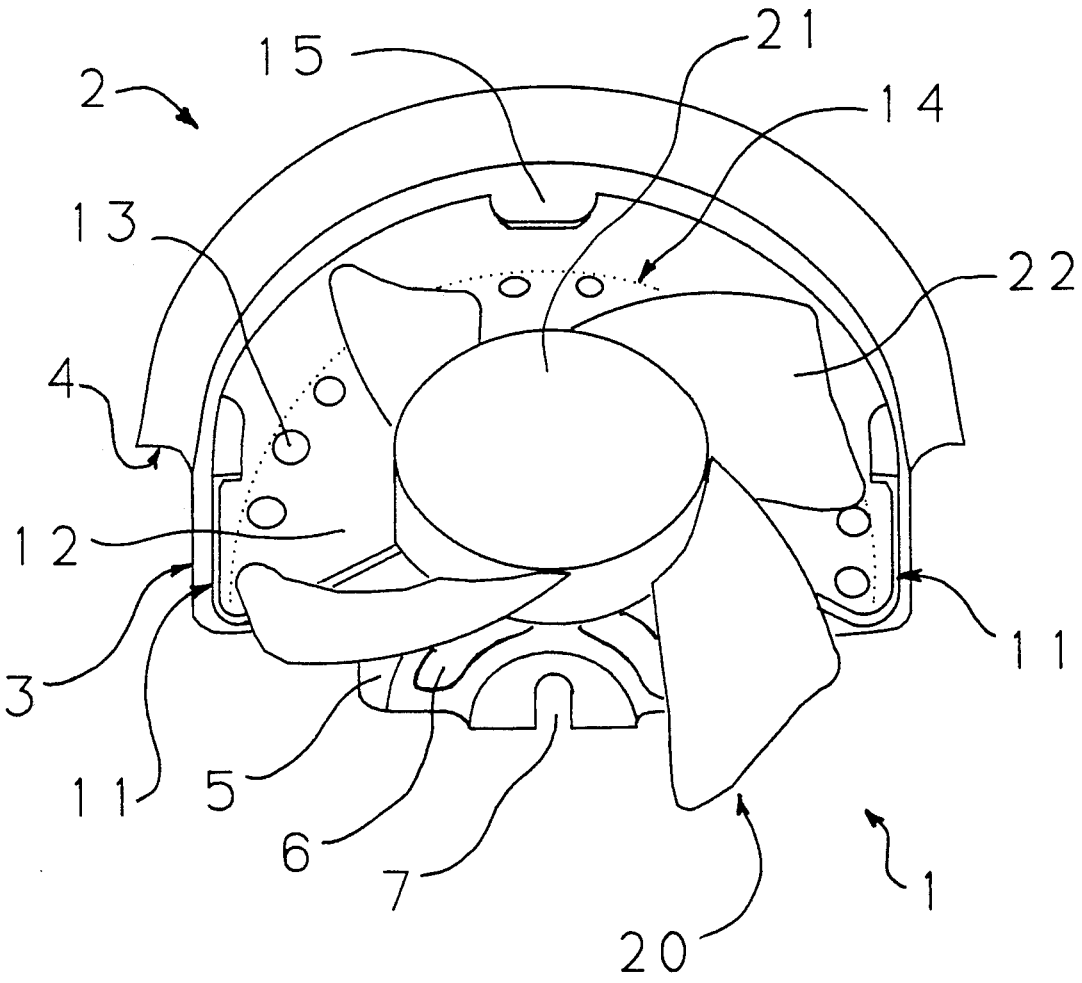
FIG. 1 is a view from a frontal upper perspective

FIG. 1 is a perspective view with a propeller-sweeper 1 in full perspective and a conventional drain assembly, 2, cut in cross-section through its diameter frontal plane.

The conventional drain assembly 2 is shown with main cylinder sidewall 3, flared lip 4 which usually engages the surface of a sink bottom, plug recess 5, concentric drain slots 6, and basket pin slot 7. The basket pin slot allows a conventional basket to assume two positions: 1. lowered—whereby a central pin on the basket protrudes through the pin slot 7; and 2. raised—whereby the central pin of the basket rotated approximately 90 degrees is seated above the slot. The oblong pin slot 7 may be employed in the invention to keep a central shaft from rotating, as will be seen in the following description.

The invention provides a prop basket 11 which is a strainer having perforations 13 around its bottom perimeter, which is accented by the dotted line 14 approximating the intersection of the prop basket cylindrical sidewalls and its floor. The bottom of the prop basket 15 is conical such that it provides a central conical apex for supporting the rotatable prop. So that the prop basket 11 can be lifted from its placement within the drain assembly 2, and so that it can be rotated while in place, multiple tab-like projections 15 are provided at the upper cylindrical edge.

A propeller 20 is shown in full perspective view. A central hub portion 21 rides on a central cone (which is best seen in the frontal cross-section of FIG. 2 which follows). Each blade 22 of the prop is swept back from the direction of rotation, and the blade edge is contoured to fit the cross-sectional outline of the prop basket.

Figure 2:
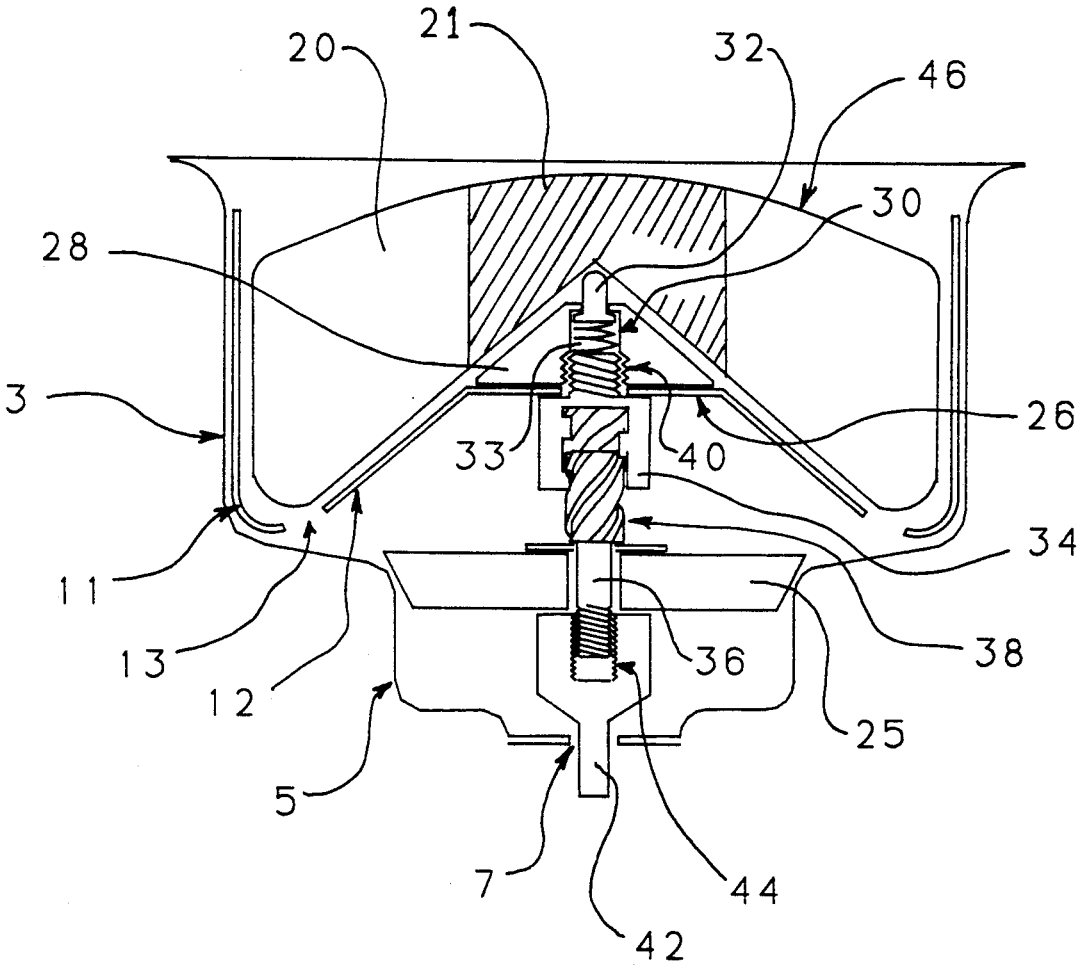
FIG. 2 is a cross-sectional view of the invention in a cross-section through a full frontal diameter

FIG. 2 is a frontal cross-section of the invention mounted within a common sink drain assembly 2.

The common drain assembly is shown in outline with cylinder sidewall 3, plug recess cylinder 5, and pin slot 7.

Prop basket 11 is shown with perforations 13 which allow egress of fluids downward. This figure demonstrates the conical bottom 12 of basket 11 which converges centrally to a truncated top region 26. Mounted upon the truncated surface 26 is a button cone 28 which completes the final conical convergence to provide a bearing surface for the propeller 20.

The button cone 28 may be generally solid, but a central cavity 30 such as a simple central bore contains components which enhance the function of the propeller. A button pin 32 is placed in the central bore protruding through the apex of the button cone and is spring loaded by button spring 33. The button cone 28 is held to the prop basket 11 by the machine screw end 40 of an upper shaft 34. The same machine screw also retains the button spring 33 within the central bore 30 of the button cone.

It should be reiterated that the following pieces are fastened together as single rotatable unit: prop basket 11; button cone 28 and its contained components; and the upper shaft 34.

Propeller 20 is primarily shown by the rotary projection outline 46 of its blades (since the swept back blades cannot be well depicted in any single cross-section). The central hub 21 of the prop bears on the button pin 32, such that it may spin elevated above the conical surfaces of the prop basket 11 and button cone 28. It can be seen from the frontal cross-section view, that downward force on the prop 20 will depress the button pin 32 to allow contact with the conical surfaces, whereby relatively soft food debris can be crushed by manual rotation of the prop.

The prop may be driven by draining fluids, during which the blades help to keep food particles agitated, so that perforations may be clear for drainage. After drainage, and any further disintegration provided by manual depression and rotation of the prop, the prop may also be driven by a directed spray which is available on a flexible hose on many sink faucet assemblies.

Since it is desirable for the prop basket 11 and the prop 20 to be left in place during sink use, and these should be in place prior to initiating actual sink drainage, then means must be provided for actuating sink drainage. A rubber plug 25 is commonly seated in the plug recess 5 of a drain. In the invention, the plug is fixed to a lower shaft 36 by machine screw threads 44 which match to the threaded bore of a pin piece 42. The pin piece 42 protrudes through the oblong pin slot 7 with a matching oblong cross-section, so that the pin piece 42, plug 25, and lower shaft 36 may not rotate, but may only move upward and downward.

The upper shaft 34 and lower shaft 36 are joined with matching coarse steep pitched threads 38, so that rotation of the upper shaft in relation to the lower shaft causes raising or lowering of the plug. Rotation of the upper shaft, (which is hidden from view of a sink user) is accomplished by rotating the entire prop basket 11 at one of its tab projections 15. It is preferred that the pitch of coarse threads 38 should accomplish a ¼" elevation (linear travel) in perhaps 360 degrees of rotation of the upper shaft (fixed to the prop basket).

The propeller spinning on its button pin bearing accomplishes the simple but tedious task of a sink user who continually sweeps debris from a clogged drain basket. Since its edges are contour fitted to the surface of the prop basket, the prop is also ideal for crushing soft debris before repeated rinsing of the basket. In two hemispheres of the earth, draining fluids have opposite directions of rotation, in the northern hemisphere, where natural rotation is in a clockwise whirlpool, the sweep of the prop blades should be oriented so as to be driven in the same direction.

Although the embodiment described can be retrofitted to the shape and constraints of a common drain found in the plumbing industry, there may be advantages to a redesign of the drain assembly which would receive the invention. It can be seen that variations in shape of the components to realize various advantages would not depart from the working principles disclosed in the invention. The embodiment employed to accomplish the principles is depicted above and defined further in the claims which follow.

I claim:

1. A device for entrapping, agitating, and fragmenting debris in draining fluid which has flow when draining from a sink through a recessed cylindrical drain into a distal tail pipe comprising:

an inner receptacle, which is a perforated cylinder having a bottom and cylindrical sidewalls and an axis, said inner receptacle inserted within said recessed cylindrical drain, wherein said inner receptacle has a concavity which is oriented upstream in relation to the flow of said draining fluid, said concavity contains a propeller positioned within said concavity and enabled to rotate in an axis substantially parallel to the axis of said inner receptacle, wherein means of closing and opening said flow is provided at a location distal and downstream to said inner receptacle.

2. A device as claimed in claim 1 further comprising:

said inner receptacle fitted and rotatable, within an upper region of said cylindrical drain recess, a stopper remotely located, below and connected to said inner receptacle, in a lower region which is said plug recess, a central shaft joined centrally to and extending downward from said bottom of said inner receptacle, said central shaft having threads at its lower end and joined at said threads to a second shaft at matching threads on said second shaft, said second shaft extending downward and has a lower end of non-cylindrical cross-section which protrudes through a similarly shaped central opening, said opening provided in said central support provided in said plug recess region, said second shaft carries said stopper mounted concentrically in said plug recess region, wherein said second shaft may not rotate at, but may slide with varying amounts of protrusion through, said central support and thus carry said stopper to or away from said plug recess according to rotation of said central shaft and said rotatable inner receptacle.

3. A device as claimed in claim 1 providing means for manually rotating or removing said inner receptacle from within said cylindrical drain recess wherein said inner receptacle is provided with inner surfaces having projections.

4. A device providing means of agitation of debris in effluent and fragmentation of debris captured from effluent passing from a sink through a cylindrical drain recess into a plumbing tailpipe comprising:

a perforated receptacle fitted within said cylindrical drain recess and having generally cylindrical sidewalls and a perforated bottom, a propeller fitted within said perforated receptacle in relationship that is upstream of said bottom, a bearing member fitted within said perforated receptacle and connected to an upper location of said bottom and said propeller positioned upon said bearing member for free rotation away from contact with said sidewalls and said bottom of said receptacle, said bearing member moveable from said upper location to a depressed position allowing said propeller to contact to said receptacle a spring mounted between said bearing member and said bottom of said receptacle and moveable in compression between said upper and said depressed position, said bearing member depressable concurrent with manual depression of said propeller and returnable by spring action to said upper position upon release of said propeller.

5. A device for agitating, fragmenting, and sweeping debris from a sink drain and shaped to be fitted within a cylindrical drain recess, said recess being suspended below a sink bottom and conveying sink effluent to a distally connected plumbing tailpipe comprising:

a receptacle fitted within said cylindrical drain recess, said receptacle having generally cylindrical sidewalls with perforations and a bottom with perforations, said bottom is shaped with a central elevation providing a bearing surface, said receptacle containing a propeller enabled to rotate upon said bearing surface at a central hub, said propeller comprising a plurality of pitched blades radially mounted to said central hub, said propeller is placed in the path of sink effluent passing between the sink and the tailpipe through said cylindrical drain recess at a location proximal and upstream to said receptacle and said perforations.

* * * * *